US006106361A

United States Patent [19]

Petris

[11] Patent Number: 6,106,361

[45] Date of Patent: Aug. 22, 2000

[54] REMOTELY CONTROLLED TOY VEHICLE

[75] Inventor: Michael John Petris, Hong Kong, The Hong Kong Special Administrative Region of the People's Republic of China

[73] Assignee: Creata International Ltd., Hong Kong, The Hong Kong Special Administrative Region of the People's Republic of China

[21] Appl. No.: 09/172,820

[22] Filed: Oct. 15, 1998

[51] Int. Cl.[7] ..... A63H 30/00

[52] U.S. Cl. ..... 446/454; 446/431; 446/444; 446/471

[58] Field of Search ..... 446/75, 77, 78, 446/93, 431, 433, 434, 435, 441, 444, 454, 471

[56] References Cited

U.S. PATENT DOCUMENTS

| | | | |
|---|---|---|---|
| 2,607,163 | 8/1952 | Lohr | 446/434 |
| 3,594,951 | 7/1971 | Perhacs, Jr. | 446/434 |
| 3,675,366 | 7/1972 | Tomiyama | 446/434 |
| 3,775,902 | 12/1973 | Gagnon | 446/434 |
| 4,045,908 | 9/1977 | Ensmann et al. . | |
| 4,192,093 | 3/1980 | Hamano | 446/435 X |
| 4,372,075 | 2/1983 | Harkins | 446/434 |
| 4,382,347 | 5/1983 | Murakami | 446/435 X |
| 4,464,860 | 8/1984 | Onodera | 446/435 X |
| 4,541,813 | 9/1985 | Ikeda | 446/444 X |
| 4,737,135 | 4/1988 | Johnson et al. | 446/435 X |
| 4,889,515 | 12/1989 | Auer et al. . | |
| 5,141,468 | 8/1992 | Suzuki | 446/435 |

FOREIGN PATENT DOCUMENTS

| | | |
|---|---|---|
| 1369134 | 10/1974 | United Kingdom . |
| 2032786 | 5/1980 | United Kingdom . |

*Primary Examiner*—Sam Rimell
*Attorney, Agent, or Firm*—Jackson Walker L.L.P.

[57] ABSTRACT

A generally conventional radio controlled toy vehicle is provided with a mother vehicle. The vehicle can be driven inside the vehicle via a ramp. Once inside, tractive drive to road wheels of the vehicle is used to drive road wheels of the vehicle. In this way, the mother vehicle can be controlled to move backwards and forwards, and be steered, by otherwise normal radio signal supplied to the vehicle.

4 Claims, 5 Drawing Sheets

REMOTELY CONTROLLED TOY VEHICLE

BACKGROUND OF THE INVENTION

1. Field of the Invention

The invention relates to remotely controlled toy vehicles.

2. Description of Prior Art

Toy vehicles can be remotely controlled by sonic (including voice) infra-red and other signals. Typically, most toy vehicles are controlled by radio signals. Radio controlled toy vehicles are well-known and comprise a vehicle that has an electric drive motor and a radio receiver that responds to radio signals from a hand-held controller/transmitter. In this way, the vehicle can be remotely controlled to move backwards and forwards and be steered by a user. It is also known to steer the vehicle by separately controlling the toy vehicles road wheels (or caterpillar tracks if appropriate, and in this specification "road wheels" will be taken to include "caterpillar tracks"). This can be done by separately driving the road wheels, or separately braking the road wheels as preferred, as known in principle for full-scale trucks and tanks for steering the vehicle.

SUMMARY OF THE INVENTION

It is an object of the invention to provide a remotely controlled vehicle that has many applications to more fully realise a potential of the radio controlled toy vehicle.

According to one aspect of the invention there is provided a remotely controlled toy vehicle having a drive motor arranged to drive road wheels of the vehicle. A control means for separately controlling at least two of the road wheels in response to control signals from a remote controller, is provided. A releasable locking mechanism is provided for locking the vehicle to a mother toy apparatus having mechanically movable parts.

The mechanically movable parts thereby cooperate directly or indirectly with road wheels when the toy vehicle is locked to the mother apparatus in a manner to allow the moving parts to be moved by controlling of the operation of the road wheels using the control signals.

The mother apparatus may be another toy vehicle that includes a housing and a ramp arranged to allow the toy vehicle to be driven into the housing and to be locked in the housing to the other vehicle.

The releasable locking mechanism is preferably arranged to be controlled by control signals from the remote controller.

According to another aspect of the invention there is provided a remotely controlled toy vehicle having a drive motor arranged to supply tractive power to a road wheel of the vehicle. A control means to control the motor in response to control signals from a remote controller is provided. A releasable locking mechanism for locking the vehicle to a mother toy apparatus having mechanically movable parts is provided so that power supplied to operate the vehicle can be transferred to the mother toy apparatus to move its movable parts under the control of the remote controller.

BRIEF DESCRIPTION OF THE DRAWINGS

A radio controlled toy according to the invention will now be described by way of example with reference to the accompanying diagrammatic drawings in which.

DESCRIPTION OF THE PREFERRED EMBODIMENT

Figure 1:
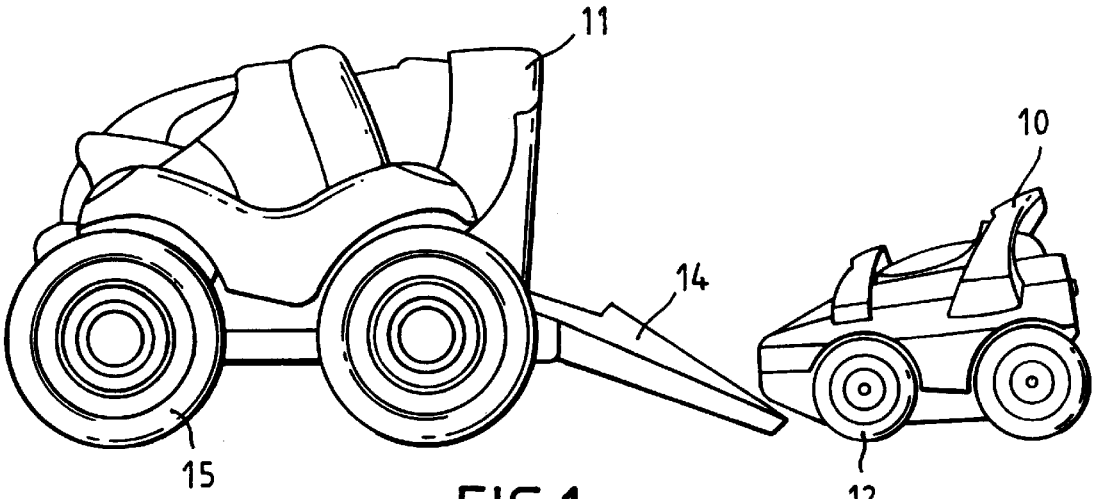
FIG. 1 is a side view of a radio controlled toy vehicle and a mother vehicle.

Referring to the drawings, in FIG. 1 a composite toy comprises a radio controlled toy vehicle 10 and a mother vehicle 11. The vehicle 10 is a radio controlled vehicle that is controlled in generally well-known manner by radio signals generated by a hand-held controller/transmitter (not shown). The vehicle 10 is controlled to move backwards and forwards under the control of the radio signals. The vehicle 10 has two motors, driving respectively left-hand side and right-hand side road wheels 12 and 13, to allow the vehicle to be steered as required, The mother vehicle 11 is hollow and the vehicle 10 can be driven up a ramp 14 to inside the vehicle 11. Once inside the vehicle 11, the ramp 14 is closed and the road wheels 12 and 13 (as explained below) act to drive road wheels 15 and 16 of the mother vehicle 11. In this way, the mother vehicle becomes controlled to move backwards and forwards, and be steered, by the radio signals from the remote controller/transmitter.

Figure 2:
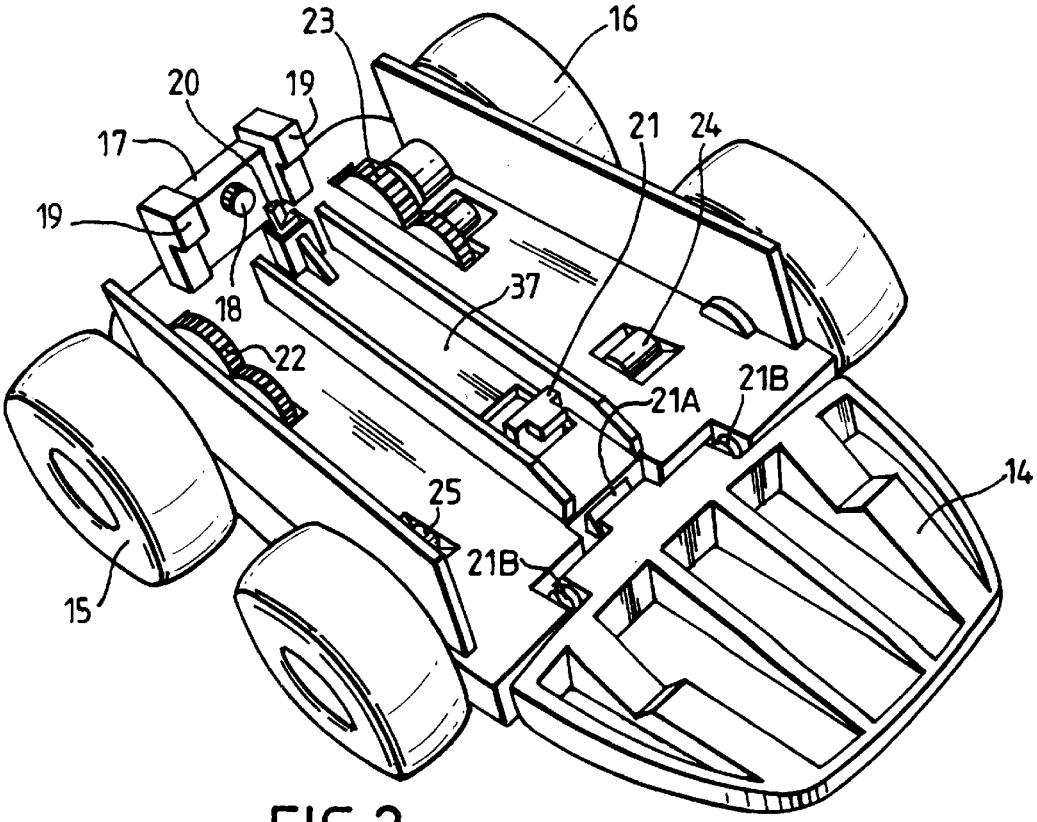
FIG. 2 is a top isometric view of the mother vehicle.

In FIG. 2, the mother vehicle 11 includes a first locking mechanism that comprises a wedge post 17 with a central post 18 and two hooks 19, and a catch post 20. A rear anchor 21 is mechanically arranged to release a catch 21A, so that the ramp closes under the action of springs 21B, on entry of the toy vehicle 10. When the vehicle 10 reverses out of the vehicle 11, the vehicle 10 forces the ramp open and recharges the springs 21B and the ramp is then held open again by the catch 21A.

Traction transfer gears 22 and 23 are provided and arranged to be mechanically coupled to road wheels 12 and 13 when the vehicle 10 is inside the vehicle 11. Free-wheeling rollers 24 and 25 are provided and positioned to be engaged by respective rear wheels of the vehicle 10.

In use, the vehicle 10 can enter inside the vehicle 11 and be locked in position by the locking mechanism 17, 18, 19 and 20 so that drive to its road wheels 12 and 13 can be applied to the vehicle 11, under control of the radio signals, via the gears 22 and 23.

Figure 3:
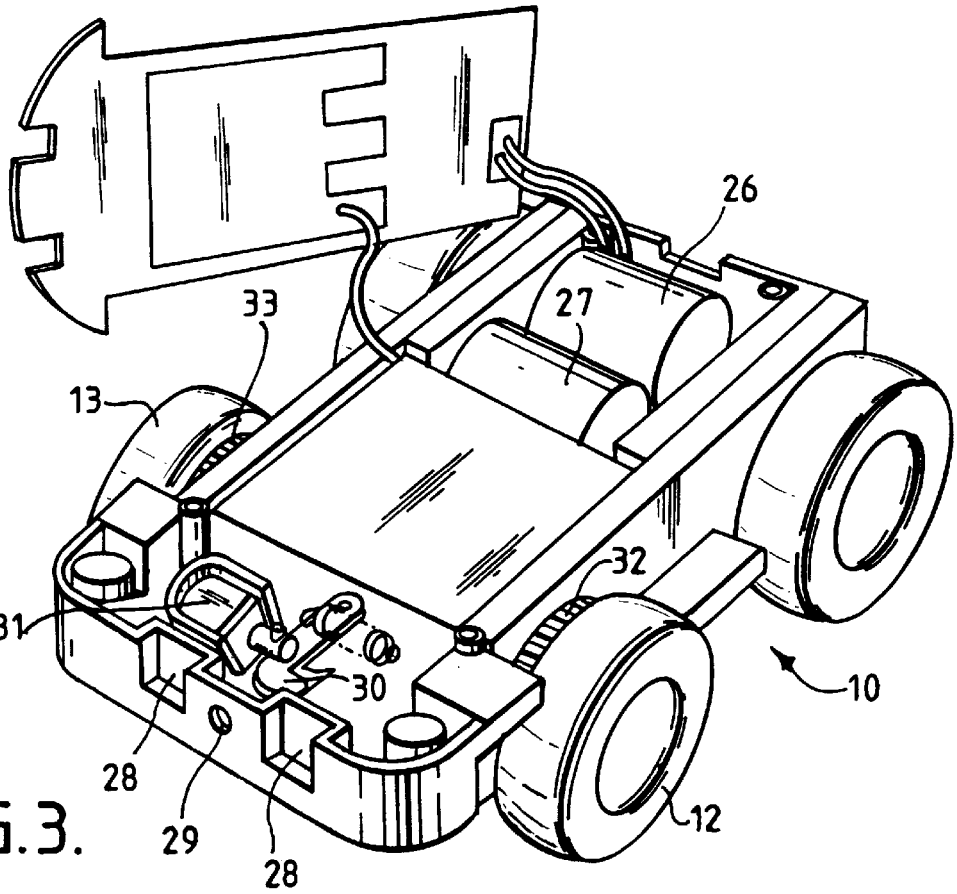
FIG. 3 is a top isometric view of the toy vehicle with a top partially removed.

In FIG. 3, the vehicle 10 has two electric drive motors 26 and 27. A second locking mechanism includes indentation 28, that engages the hooks 19 in FIG. 2, an aperture 29 that fits to the post 18, and a pivoted hook 30 to engage the catch post 20. The hook 30 is spring-biassed and provided with a solenoid operated release mechanism 31, that is arranged to be controlled by radio signals from the remote controller/transmitter. Gears 32 and 33 are mounted adjacent and inside the road wheels 12 and 13, respectively. In practice, when the vehicle 10 is driven into the vehicle 11, the first and second locking mechanisms automatically engage with one another to hold the vehicle 10 inside the vehicle 11. The locking mechanism are designed and arranged to hold the vehicle firmly in position and, in particular, to ensure that the gears 32 and 33 are pressed securely against the driving gears 22 and 23.

Figure 4:
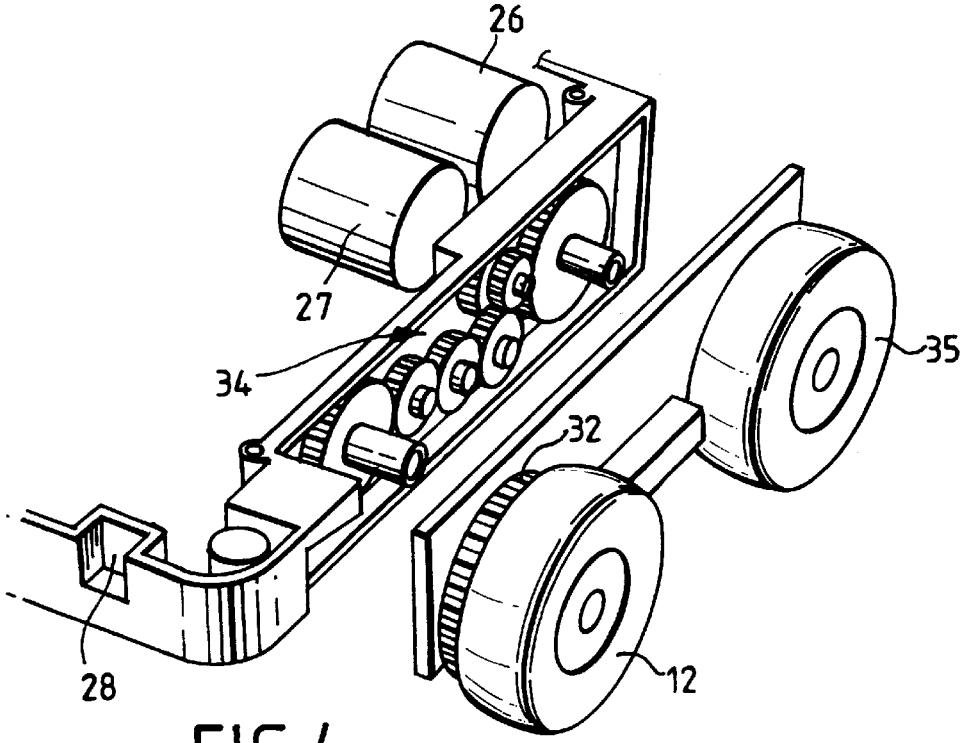
FIG. 4 is an isometric partial view of the toy vehicle showing a mechanical drive arrangement.

In FIG. 4, one side gear train 34 is shown for the vehicle 10. It will be noted that a rear wheel 35 is also driven by the motor 27; the motor 26 drives both right-hand side road wheels of the vehicle 10. The vehicle 10 therefore a four-wheel drive vehicle.

Figure 5:
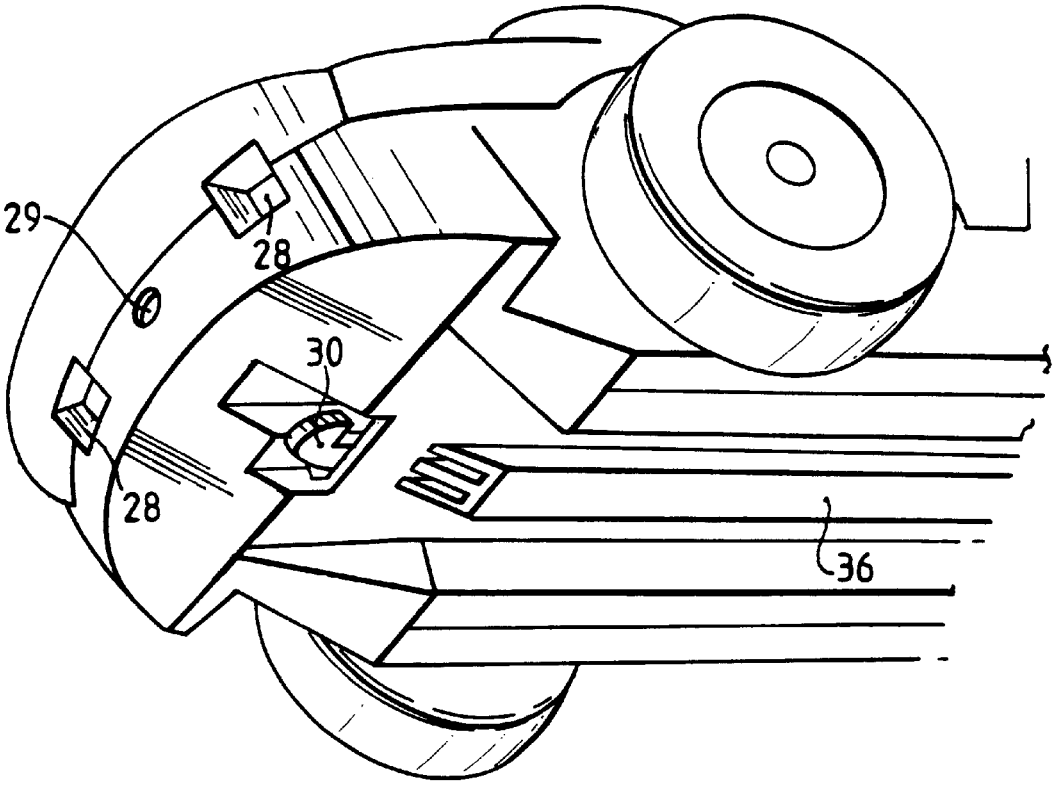
FIG. 5 is a partial isometric underside view of the toy vehicle.

In FIG. 5, it can be seen that the vehicle 10 has a central channel 36 can be located in a central groove 37 (see FIG. 2) provided in the vehicle 11 and serves to inhibit relative horizontal pivoting of the vehicle 10 about the locking mechanisms when locked to the vehicle 11. The channel 36 and central groove 37, which may be provided with opposing flangers, also cooperate to guide the vehicle 10 centrally forwards so that the locking mechanisms parts will automatically mate together as required.

Figure 6:
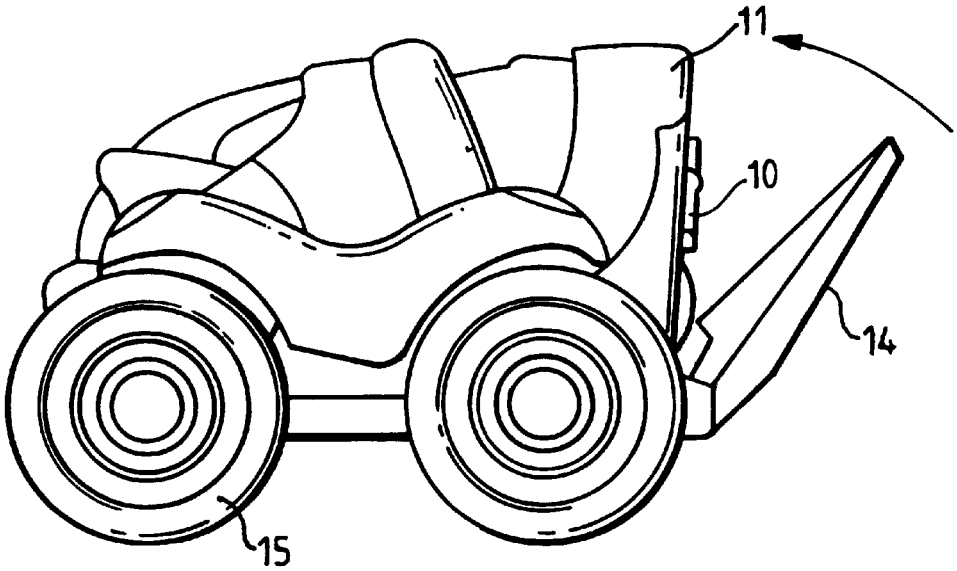
FIG. 6 is a side view of the mother vehicle.
Figure 7:
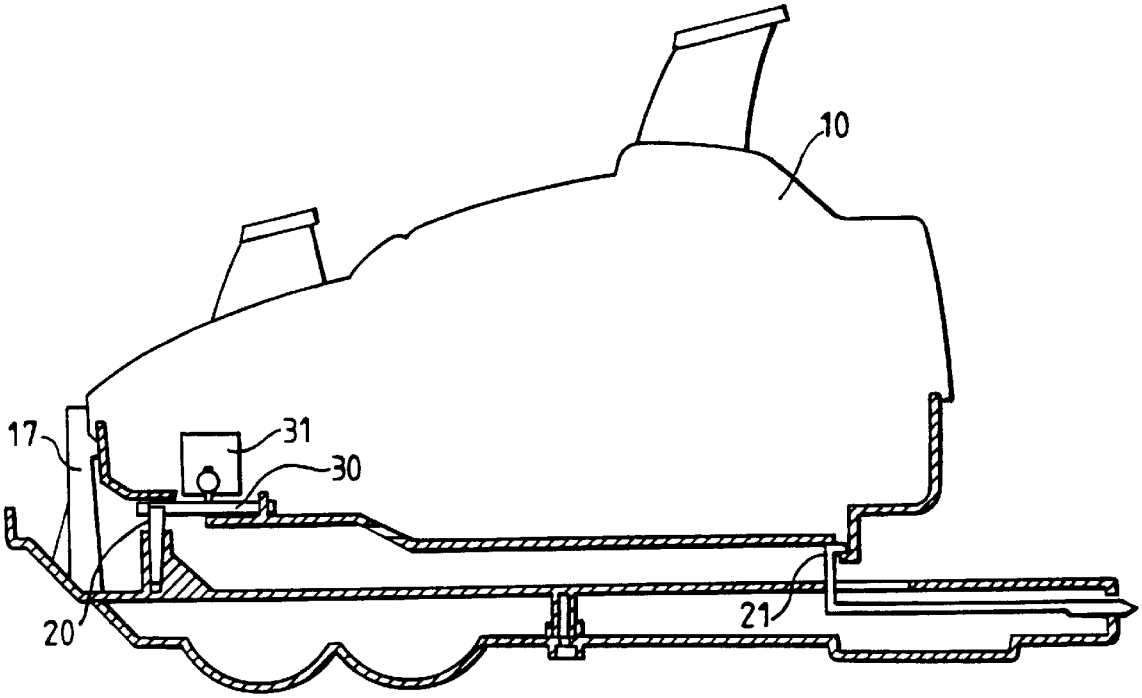
FIG. 7 is a partial sectional side view of the toy vehicle and the mother vehicle.
Figure 8:
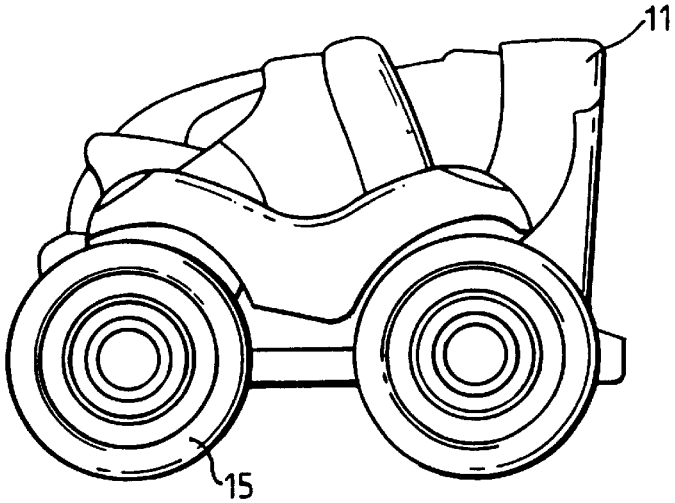
FIG. 8 is a side view of the mother vehicle.

In FIG. 6, the vehicle 10 is shown in position when it has almost completely entered inside the vehicle 11. The ramp 14 is being closed by the vehicle 10 pulling against the rear anchor 21 (see FIG. 2). This is shown more clearly in FIG. 7, where the ramp 14 is completely closed and as shown externally in FIG. 8.

Figure 9:
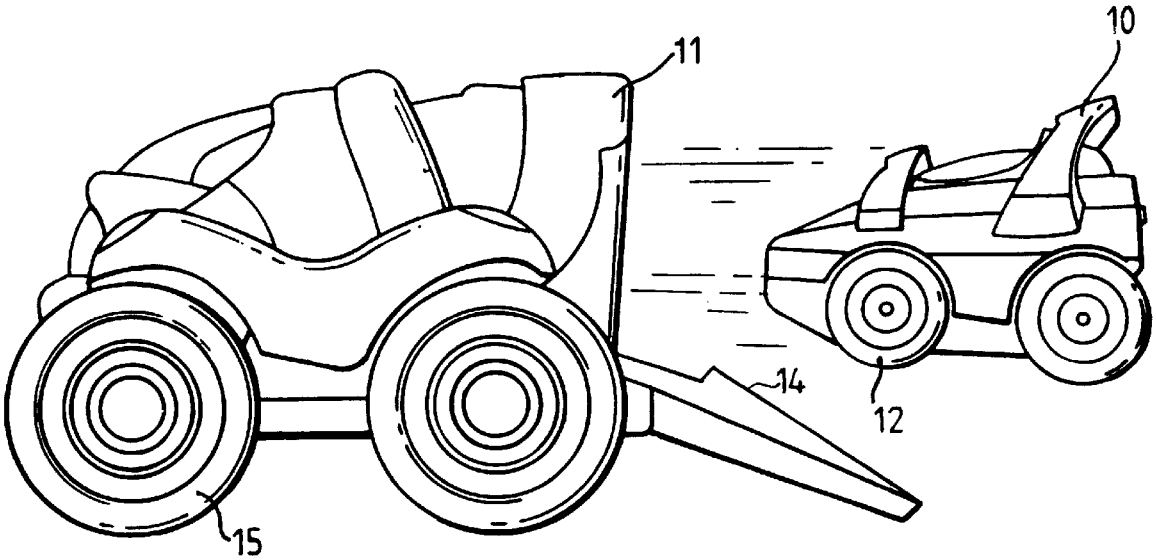
FIG. 9 is a side view of the toy vehicle and the mother vehicle showing the toy vehicle being rejected out of a rear of the mother vehicle.

In FIG. 9, the vehicle 10 is being "ejected" out of the rear of the vehicle 11. This occurs when the solenoid 31 is operated and maximum reverse power is applied to the wheels of the vehicle 10. Thereafter, the vehicle 10 can be operated again as a "normal" radio controlled car in generally conventional manner.

It will be noted that the road wheels of the vehicle 10 engage the road wheels "indirectly", that is to say via gears 32 and 33 and this provides a very positive and robust mechanical connection to the gears 22 and 23. In other embodiments however, the road wheels 12 and 13 are arranged to drive "directly" by being pressed against, say, rubber gears 22 and 23 or against the road wheels 15 and 16 into direct contact. Also, as mentioned earlier the vehicle 10 and/or 11 may have "road wheels" in the form of caterpillar tracks.

Figure 10:
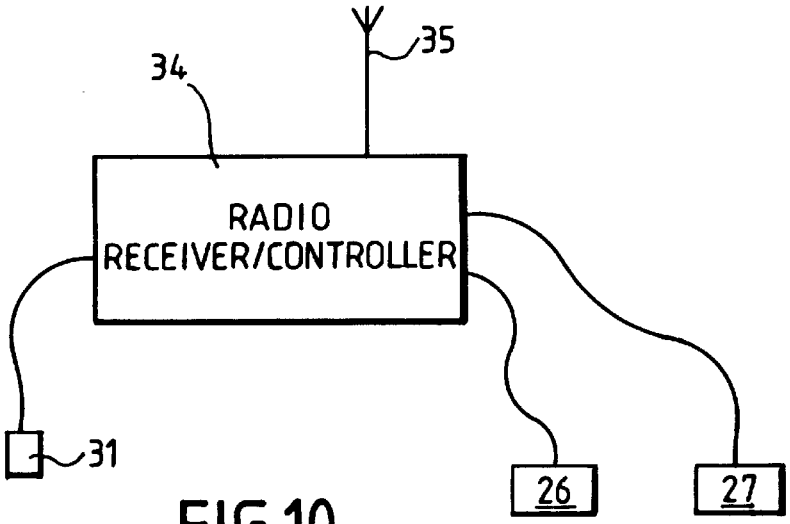
FIG. 10 is a schematic layout of a radio receiver/controller for the radio controlled toy.

In FIG. 10, a radio receiver/controller 34, that is mounted in the vehicle 10, has an antenna 35 for receiving radio signals from the remote transmitter/controller. In turn, the controller 34 applies signals as required to the motors 26 and 27, and to the solenoid 31.

Other embodiments of the invention comprise composite toys comprising the vehicle 10 and other "mother apparatuses". The other apparatus can comprise cranes with moving parts, lifts, or animated toys, say. In each case the vehicle 10 is arranged to drive to and be releasably lockable to a "mother apparatus". In the locked position, the remote controller/transmitter is used to send signals to the vehicle la and the wheel drives of the vehicle used to selectively arrange to control moving parts in the mother apparatus in effect via the road wheels, directly or indirectly as explained.

In this way, the traction power of the vehicle 10 is used to generate various remotely controlled movements of the crane, the lift, the animated toys and so forth as desired, so broadening use of the vehicle 10 to provide a range of added applications.

It is possible to use a toy vehicle that has only one traction power outlet (i.e. only one road wheel or axle is connected to be driven by one motor). The traction power can still be used to power a mother vehicle, or the crane, lift and animated toys in the same manner as described.

Embodiments of the invention can be arranged to respond to sonic, audio (including voice), or infra-red signals supplied by and transmitted remotely from any suitable source, The vehicle 10 may be powered by other forms of power other than electric power, including steam or a wind-up spring for example. Also, the vehicle 10 may be arranged to transfer power, or use the power source normally used for traction (e.g. a battery pack), directly to a mother apparatus once the vehicle 10 is inside and/or locked to a mother apparatus. In other words, the vehicle 10 does not necessarily provide mechanical forces for operation of the mother apparatus via its road wheels or its transmission system.

In one embodiment of the invention, there are provided at least two mother vehicles, the one arranged to fit inside the other. The vehicle 10 is arranged to enter the innermost vehicle and so serve to drive that vehicle, and to drive the outermost vehicle when they are all joined together, under the control of the remote controller.

I claim:

1. A remotely controlled toy vehicle and mother toy apparatus combination comprising:

a drive motor arranged to drive road wheels of said vehicle;

a control means for separately controlling at least two of said road wheels in response to control signals from a remote controller; and a releasable locking mechanism for locking said vehicle to said mother toy apparatus, said mother toy apparatus having mechanically movable parts, said mechanically movable parts driven by said road wheels when said toy vehicle is locked to said mother apparatus to allow said moving parts to be moved by separately controlling operation of said at least two road wheels using said control signals.

2. The remotely controlled combination according to claim 1, wherein said mother toy apparatus is a second toy vehicle having a housing and a ramp arranged to allow said toy vehicle to be driven into said housing and locking means to lock said toy vehicle inside said housing.

3. The remotely controlled combination according to claim 1, wherein said releasable locking mechanism is released by control signals from said remote controller.

4. A remotely controlled toy vehicle and mother toy apparatus combination comprising:

a drive motor arranged to supply tractive power separately to at least two wheels of said vehicle;

control means to control said motor in response to control signals from a remote controller; and a releasable locking mechanism for locking said mother toy apparatus, said mother toy apparatus having mechanically movable parts such that power supplied to operate said vehicle can be transferred to said mother toy apparatus via said at least two road wheels to move said movable parts under control of said remote controller.

* * * * *